US008272894B2

(12) United States Patent
Chiu

(10) Patent No.: US 8,272,894 B2
(45) Date of Patent: Sep. 25, 2012

(54) COAXIAL CONNECTOR

(75) Inventor: Ching-Yang Chiu, Taipei (TW)

(73) Assignee: Primecon Technology Ltd., Taipei (TW)

( * ) Notice: Subject to any disclaimer, the term of this patent is extended or adjusted under 35 U.S.C. 154(b) by 0 days.

(21) Appl. No.: 13/409,655

(22) Filed: Mar. 1, 2012

(65) Prior Publication Data

US 2012/0164879 A1 Jun. 28, 2012

Related U.S. Application Data

(63) Continuation-in-part of application No. 12/940,372, filed on Nov. 5, 2010.

(51) Int. Cl.
*H01R 9/05* (2006.01)

(52) U.S. Cl. ..... 439/582

(58) Field of Classification Search ..... 439/63, 439/578–585, 675, 394, 881, 322
See application file for complete search history.

(56) References Cited

U.S. PATENT DOCUMENTS 7,485,000 B2 2/2009 Zeng

*Primary Examiner* — Phuong Dinh
(74) *Attorney, Agent, or Firm* — Morris Manning & Martin LLP; Tim Tingkang Xia, Esq.

(57) ABSTRACT

A coaxial connector includes a terminal, an insulating housing for receiving the terminal therein, and a shell for receiving the insulating housing therein. The terminal includes a carrier plate; two contacts correspondingly provided at their facing sides with two concaved areas for electrically connecting with an external round-shaped conductor; and a first and a second fastening plate for fastening to a core wire of a cable. The two contacts and the first and second fastening tabs are oriented toward the same direction. With the above arrangements, the coaxial connector can be easily assembled and have reduced assembly height, the first and second fastening plates are in direct contact with the core wire to securely fasten the same to the terminal, and the contact area between the contacts and the external round-shaped conductor is increased, ensuring good electrical signal transmission via the coaxial connector.

4 Claims, 11 Drawing Sheets

COAXIAL CONNECTOR

CROSS-REFERENCE TO RELATED APPLICATION

This application is a continuation-in-part patent application of U.S. application Ser. No. 12/940,372 filed on Nov. 5, 2010, the entire contents of which are hereby incorporated by reference for which priority is claimed under 35 U.S.C. §120.

FIELD OF THE INVENTION

The present invention relates to a coaxial connector, and more particularly to a coaxial connector that has reduced assembly height and includes a terminal having a first and a second fastening plate for directly fastening to a core wire of a cable as well as two contacts provided on their facing sides with concaved areas to increase the contact area between the contacts and an external conductor, making the coaxial connector easy to assemble and secure in structure to ensure good electrical contact and accordingly, excellent electrical signal transmission effect.

BACKGROUND OF THE INVENTION

FIG. 1 is an exploded perspective view showing a conventional coaxial connector for connecting to a cable 6 (U.S. Pat. No. 7,485,000 B2). As shown, the conventional coaxial connector includes a terminal 7, an insulating housing 8, and a shell 9. The cable 6 includes a core wire 61, an insulating layer 62, a braided shield 63, and a jacket 64. The terminal 7 includes a carrier plate 71, two contacts 72, two clamping members 73, and two insertion members 74. The insulating housing 8 includes a receiving space 81, two holding holes 82, a pressing plate 83, two retaining slots 84, and a notch 85. The shell 9 includes a socket portion 91, two protruded blocks 92, two retaining hooks 93, and a cover portion 94. FIGS. 2 to 8 illustrate the assembling of the above-described components to one another to form the conventional coaxial connector. Please refer to FIG. 1 along with FIGS. 2 to 8. The clamping members 73 of the terminal 7 pierce into the insulating layer 62 of the cable 6 when the latter is forced into between the clamping members 73, so that the core wire 61 of the cable 6 is electrically connected to the clamping members 73 of the terminal 7. Then, the terminal 7 with the cable 6 assembled thereto is positioned in the receiving space 81 of the insulating housing 8 with the insertion members 74 extended into the holding holes 82. The insulating housing 8 with the terminal 7 and the cable 6 assembled thereto is then fitted in the socket portion 91 of the shell 9, such that the protruded blocks 92 are engaged with the retaining slots 84 and the retaining hooks 93 hold the insulating housing 8 in the socket portion 91. Finally, bend the cover portion 94 toward the socket portion 91 to press the pressing plate 83 against the insulating layer 62 of the cable 6 and complete the conventional coaxial connector.

The conventional coaxial connector with the above described structure has at least the following disadvantages:

(1) The core wire 61 of the cable 6 is electrically connected to the clamping members 73 of the terminal 7 by piercing the insulating layer 62 of the cable 6 with the clamping members 73. This type of connection does not ensure stable electrical contact of the terminal 7 with the core wire 61 of the cable 6, and is subject to the risk of instantaneous power interruption.

(2) The insulating layer 62 of the cable 6 serves as a pilot when the terminal 7 is electrically connected to the core wire 61 of the cable by piercing through the insulating layer 62.

Therefore, it is time consuming and difficult to accurately position the insulating layer 62 of the cable 6 in between the clamping members 73 of the terminal 7.

(3) As can be seen from FIG. 7, when the contacts 72 deviate from their original positions, it is unable to correspondingly correct the relative position of an external round-shaped conductor 5 inserted in between the contacts 72. Further, the coaxial connector has largely reduced electrical signal transmission effect because there are only two contacting points between the external round-shaped conductor 5 and the contacts 72, which fails to ensure good electrical contact between the conductor 5 and the terminal 7.

(4) The contacts 72 and the clamping members 73 are oriented toward different directions, and the terminal 7 is held in place by inserting the insertion members 74 on the carrier plate 71 into the holding holes 82 in the receiving space 81. Since the terminal 7 is too small to be easily and accurately positioned in the insulating housing 8, it is possible the terminal 7 becomes separated from the insulating housing 8 later. Since the contacts and the clamping members 73 are oriented toward different directions, the clamping members 73 of the terminal 7 and the cable 6 assembled thereto will protrude from an outer side of the carrier plate 71 when the contacts 72 are received in the insulating housing 8. The protruded clamping members 73 and cable 6 result in increased assembly height of the terminal 7, preventing the terminal 7 and the cable 6 from being completely received in the insulating housing 8.

(5) A tool is needed for pushing the insulating housing 8 into the socket portion 91 of the shell 9, and the protruded blocks 92 in the socket portion 91 move upward from a bottom of the retaining slots 84 when the insulating housing 8 is fitted into the socket portion 91. The protruded blocks 92 form a resistance to the movement of the insulating housing 8 into the socket portion 91 and tend to scratch the insulating housing 8 to produce scraps, which fall into the receiving space 81 of the insulating housing 8 to adversely affect the electrical property of the assembled coaxial connector.

Under these circumstances, it is desirable to work out a coaxial connector that can be easily assembled to have reduced assembly height and firm structure, and ensures good electrical contact with an external conductor to provide excellent electrical signal transmission effect.

In view of the disadvantages in the conventional coaxial connector, the inventor has developed an improved coaxial connector that can be easily and securely assembled to ensure low assembly height, good electric contact and excellent electrical signal transmission effect.

SUMMARY OF THE INVENTION

A primary object of the present invention is to provide a coaxial connector that includes a terminal having a first and a second fastening plate as well as two contacts, all of which are oriented toward the same direction; wherein the first and second fastening plates are used to directly fasten to a core wire of a cable, and the two contacts are provided on their facing sides with concaved areas to increase the contact area between the contacts and an external round-shaped conductor, so that the coaxial connector can be easily and securely assembled to ensure good electrical contact and accordingly good electrical signal transmission effect.

To achieve the above and other objects, the coaxial connector according to the present invention is designed for electrically connecting a cable having a core wire to an external round-shaped conductor, and includes a terminal, an insulating housing, and a shell. The terminal includes a carrier plate; two contacts correspondingly provided on two opposite lateral edges of the carrier plate and bent toward the same direction to locate at the same side of the carrier plate; and a first and a second fastening tab separately provided on the two opposite lateral edges of the carrier plate near an end of the carrier plate opposite to the contacts and located at positions offset from each other. The two contacts and the first and second fastening tabs are oriented toward the same direction; the first and second fastening tabs are used to fasten and electrically connect to the core wire of the cable; and the two contacts are correspondingly provided on their facing sides with two concaved areas for electrically connecting to the external round-shaped conductor. The insulating housing includes a guiding section; a receiving space located on one side of the insulating housing for receiving the terminal therein; and a pressing plate outward extended from the receiving space for pressing against the terminal. The shell includes a socket portion for correspondingly receiving the guiding section of the insulating housing therein; a cover portion axially outward extended from an end of the socket portion for pressing against the pressing plate; and a plurality of clamping sections provided on two opposite lateral edges of the cover portion for clamping onto the cable.

The shell further includes two stoppers correspondingly protruded from the socket portion to give the socket portion a substantially U-shaped interior for receiving the guiding section of the insulating housing therein, and two retaining sections provided on the cover portion for fastening to the two stoppers.

The insulating housing further includes an extended portion axially outward extended from an end of the guiding section opposite to the pressing plate, and a through hole defined in the guiding section and the extended portion and communicating with the receiving space for receiving the contacts of the terminal therein.

The insulating housing further includes two locating blocks correspondingly located at two lateral outer sides of the guiding section, and the shell further includes two recesses formed on an end of the socket portion facing toward the cover portion for separately engaging with the locating blocks on the insulating housing.

With the above arrangements, the coaxial connector assembled to the cable can have reduced assembly height, and the first and second fastening tabs can cooperatively fasten the core wire to securely fasten the cable to the terminal. Therefore, the coaxial connector is easy to assemble and provides good electrical contact and accordingly good electrical signal transmission effect.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENTS

The present invention will now be described with a preferred embodiment thereof and with reference to the accompanying drawings.

Figure 1:
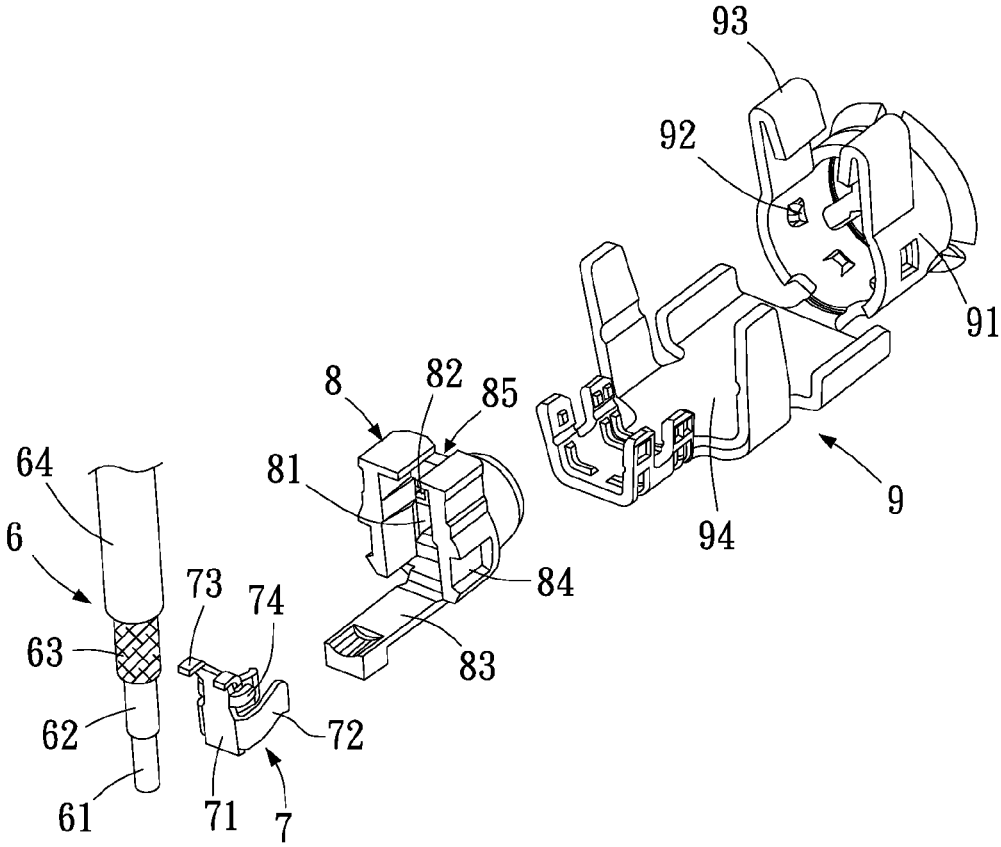
(PRIOR ART) FIG. 1
FIG. 1 is an exploded perspective view of a conventional coaxial connector.
Figure 2:
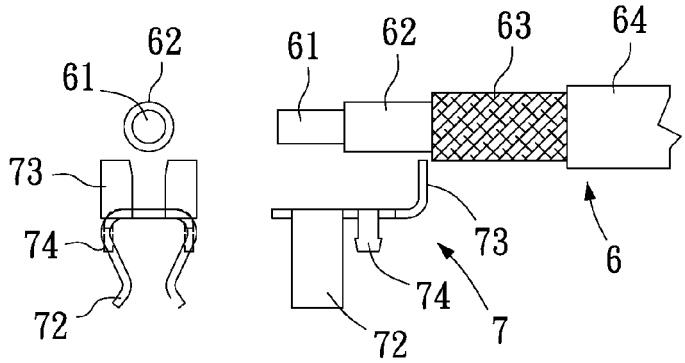
(PRIOR ART) FIG. 2
FIGS. 2 to 4 illustrate the assembling of a terminal of the conventional coaxial connector of FIG. 1 to a cable.
Figure 3:
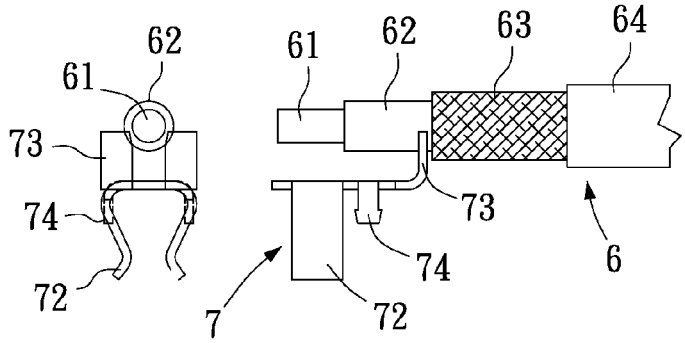
(PRIOR ART) FIG. 3
Figure 4:
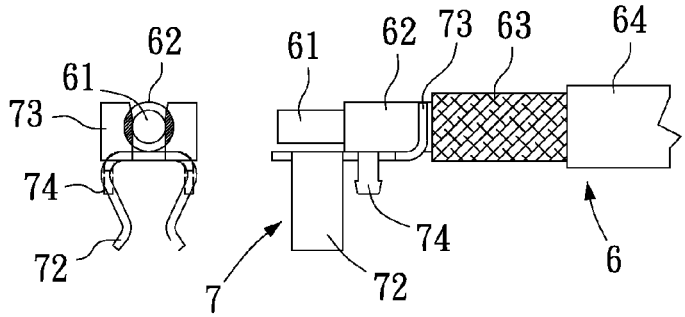
(PRIOR ART) FIG. 4
Figure 5:
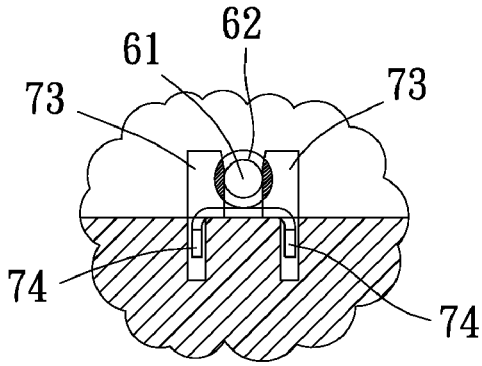
(PRIOR ART) FIG. 5
FIG. 5 is a front view showing the terminal of the conventional coaxial connector of FIG. 1 and the cable assembled thereto.
Figure 6:
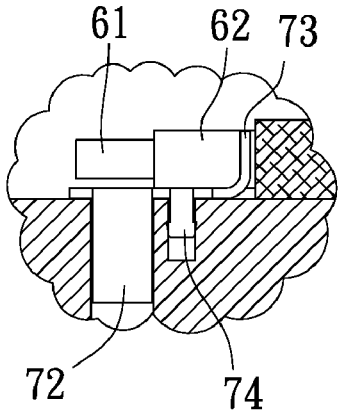
(PRIOR ART) FIG. 6
FIG. 6 is a side view showing the terminal of the conventional coaxial connector of FIG. 1 and the cable assembled thereto.
Figure 7:
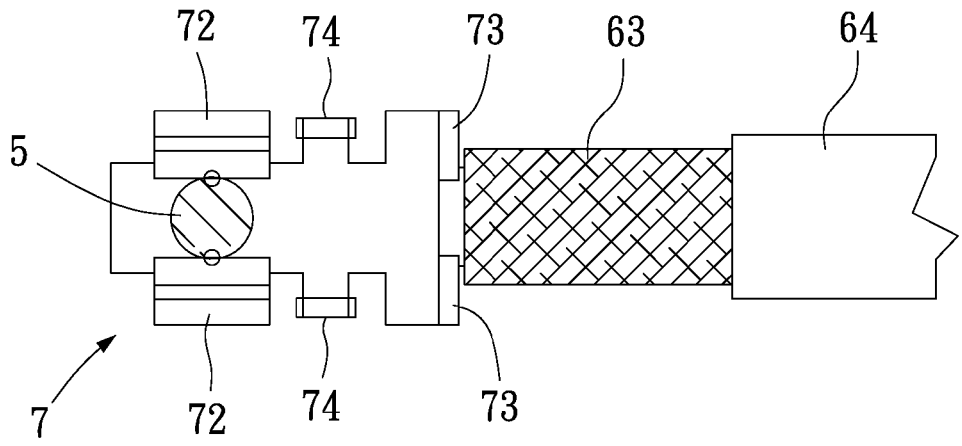
(PRIOR ART) FIG. 7
FIG. 7 is a top view showing the terminal of the conventional coaxial connector of FIG. 1 and the cable assembled thereto.
Figure 8:
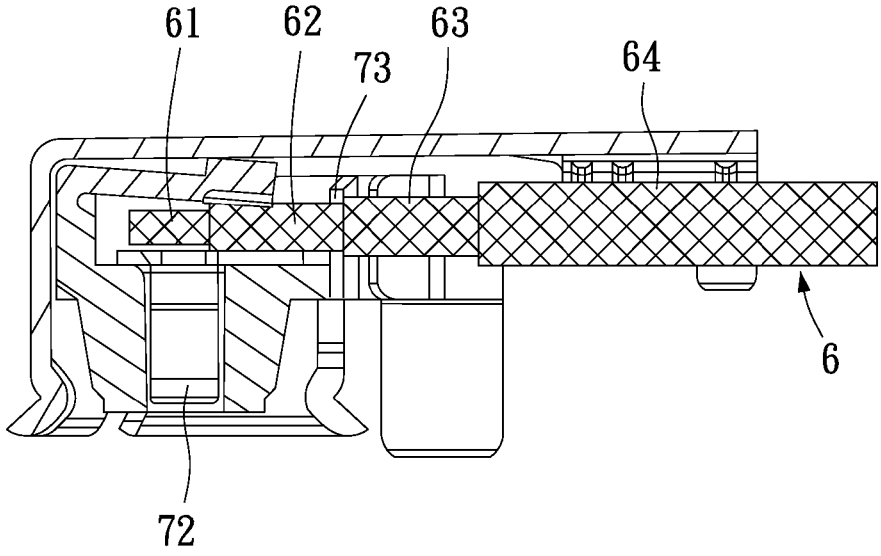
(PRIOR ART) FIG. 8
FIG. 8 is a sectional side view showing the assembling of the assembled terminal and cable to an insulating housing and a shell of the conventional coaxial connector of FIG. 1.
Figure 9:
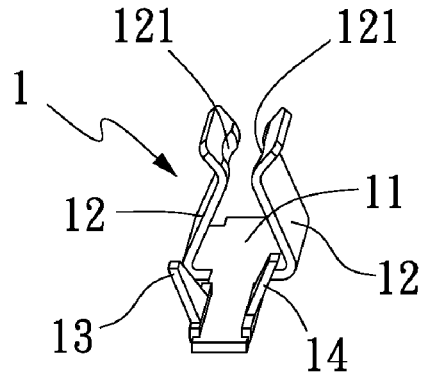
FIG. 9 is a perspective view of a terminal for a coaxial connector according to the present invention.
Figure 10:
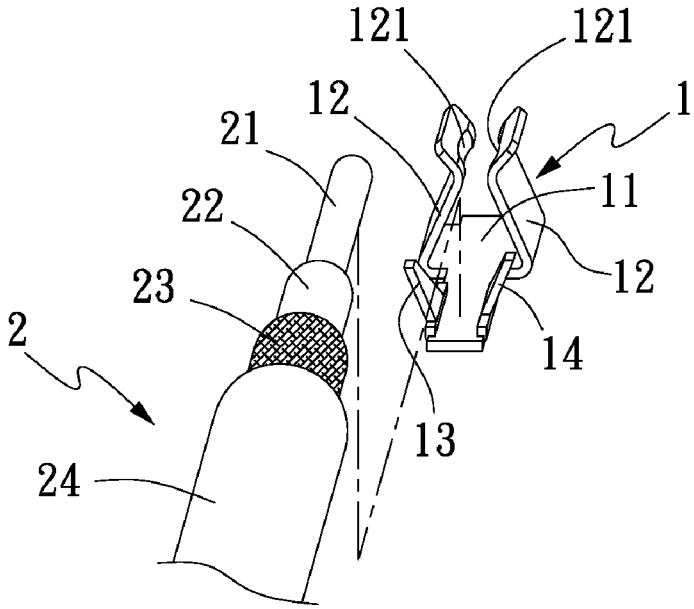
FIG. 10 shows a cable and the terminal of the coaxial connector of the present invention before being assembled together.
Figure 11:
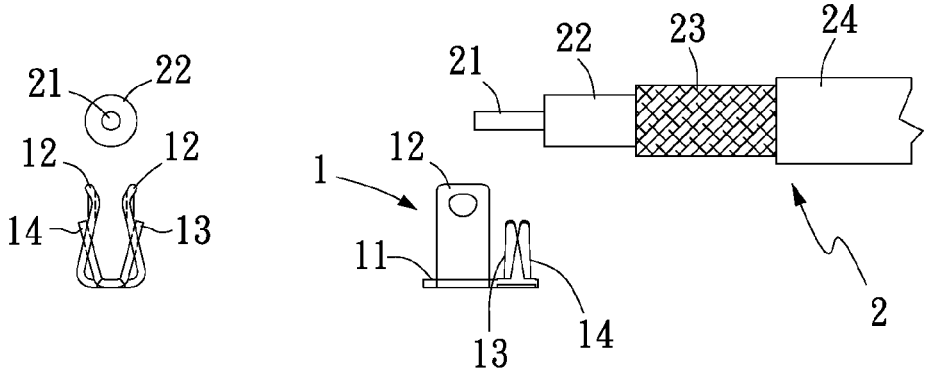
FIGS. 11 to 13 illustrate the assembling of the terminal of the coaxial connector of the present invention to the cable of FIG. 10.
Figure 12:
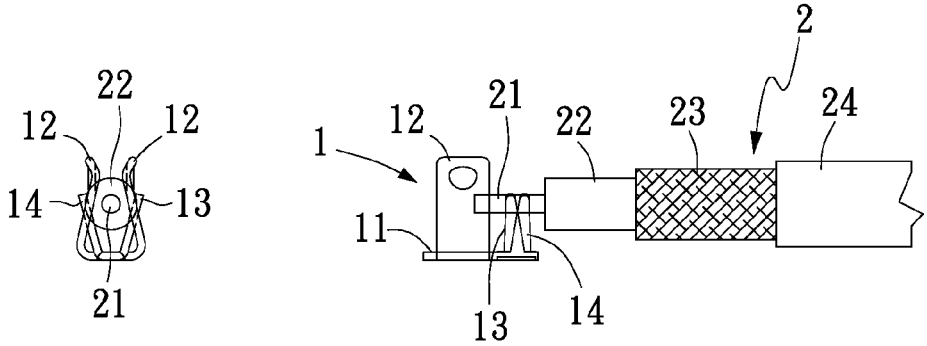
Figure 13:
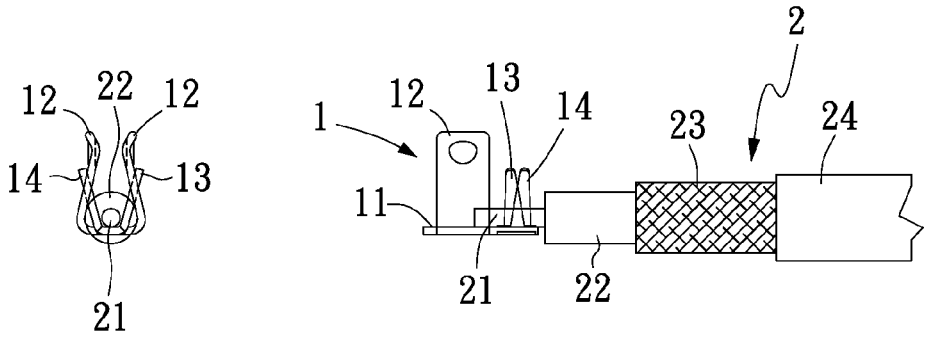
Figure 14:
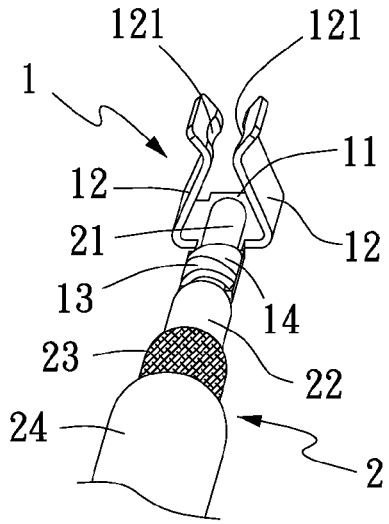
FIG. 14 is a perspective view showing the terminal of the coaxial connector of the present invention and the cable assembled thereto.
Figure 15:
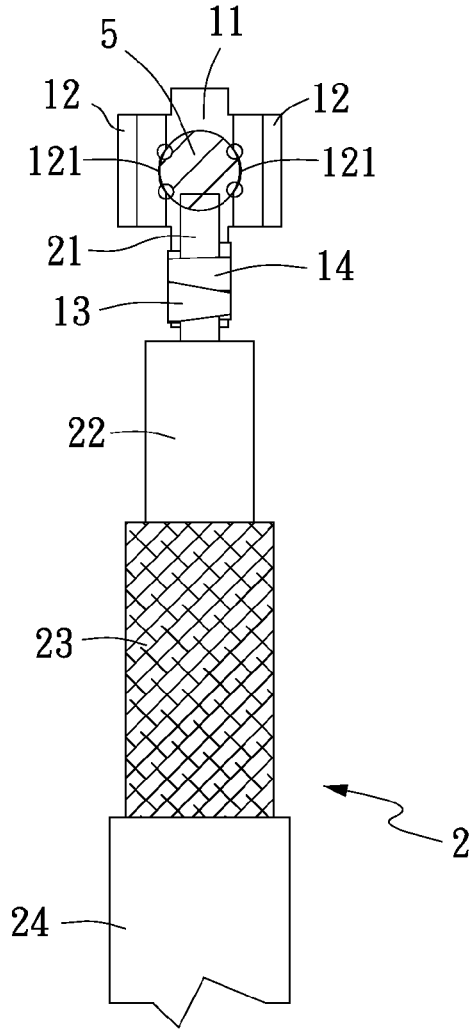
FIG. 15 is a top view showing the terminal of the coaxial connector of the present invention and the cable assembled thereto.
Figure 16:
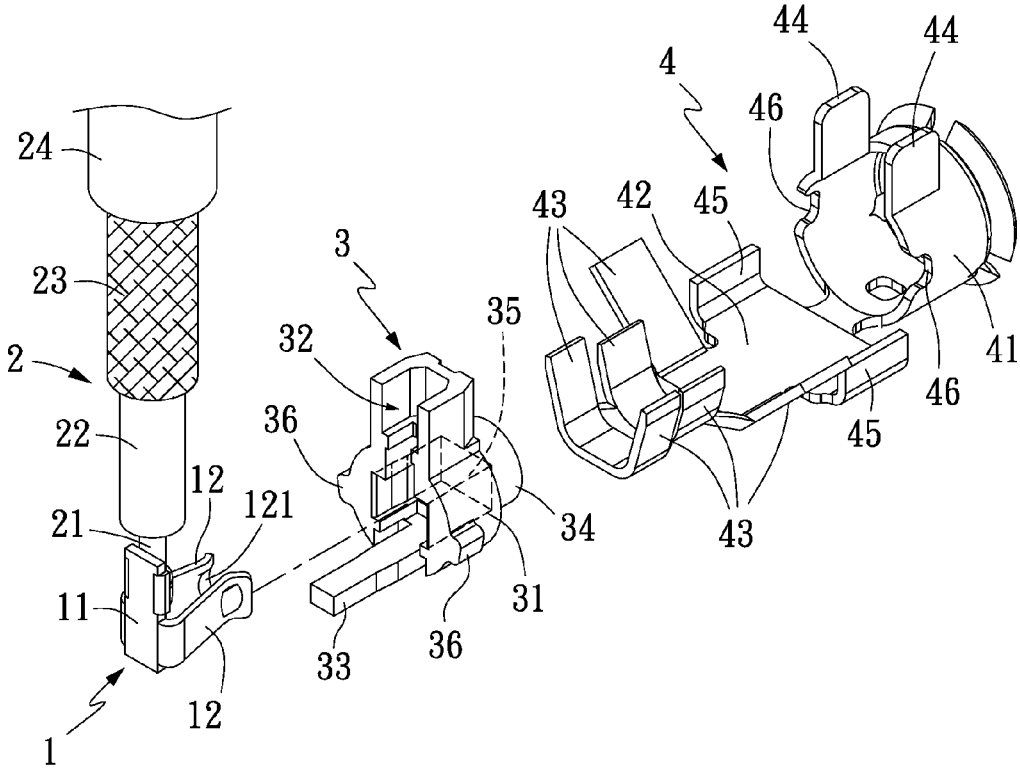
FIG. 16 is an exploded perspective view showing the terminal, an insulating housing, and a shell of the coaxial connector of the present invention, as well as the cable to be assembled thereto.
Figure 17:
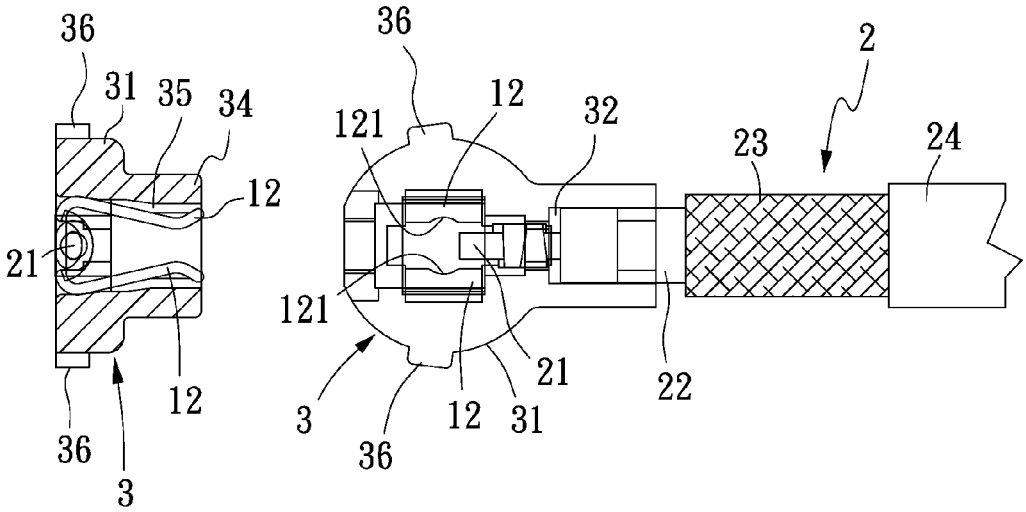
FIG. 17 is a top view showing the assembling of the insulating housing of the coaxial connector of the present invention to the assembled terminal and cable.
Figure 18:
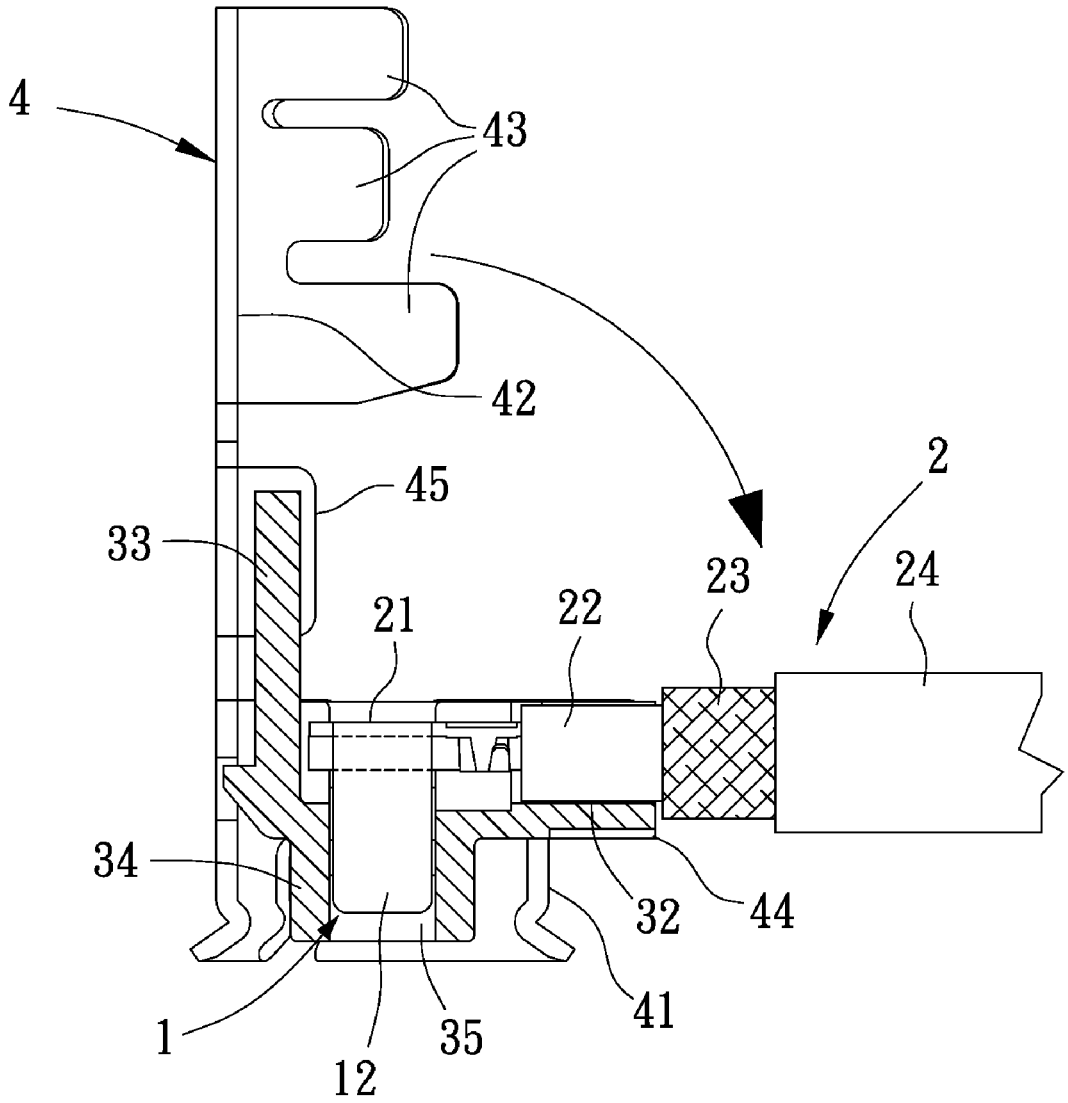
FIG. 18 shows the assembling of the shell of the coaxial connector of the present invention to the assembled terminal, cable and insulating housing.
Figure 19:
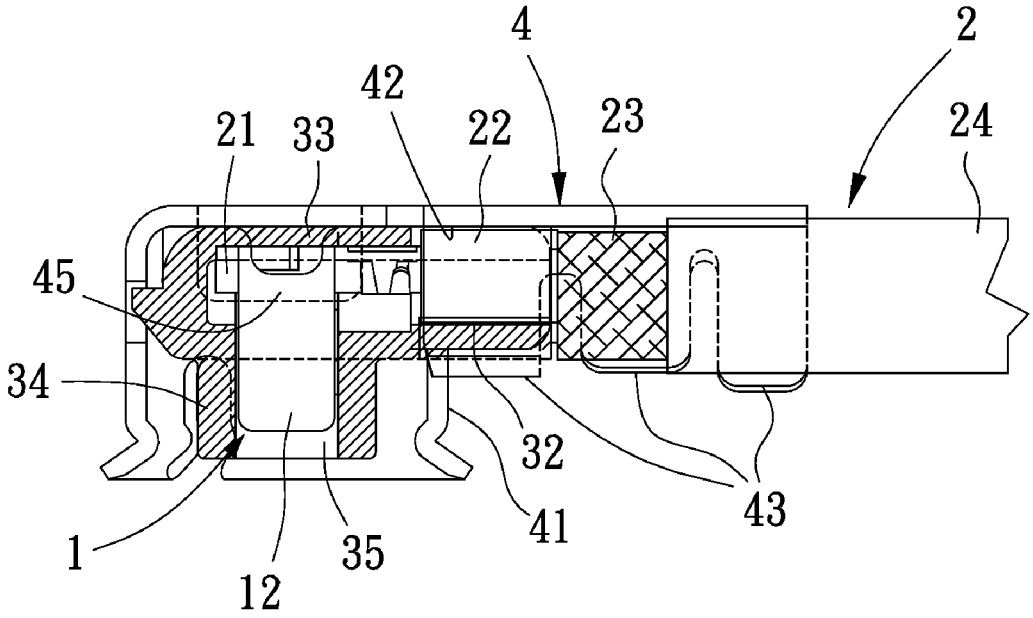
FIG. 19 is a partially sectioned side view showing the cable and the terminal, the insulating housing and the shell of the coaxial connector of the present invention in a fully assembled state.

Please refer to FIG. 16 that is an exploded perspective view of a coaxial connector according to a preferred embodiment of the present invention. As shown, the coaxial connector of the present invention includes a terminal 1, an insulating housing 3, and a shell 4. The terminal 1 is used to electrically connecting a cable 2 to an external round-shaped conductor 5 (see FIG. 15). The cable 2 includes a core wire 21, an insulating layer 22 enclosing the core wire 21, a braided shield 23 enclosing the insulating layer 22, and a jacket 24 enclosing the braided shield 23. Please refer to FIG. 9 that is a perspective view of the terminal 1 of the coaxial connector of the present invention. As shown, the terminal 1 includes a carrier plate 11, two contacts 12 correspondingly provided on two opposite lateral edges of the carrier plate 11 and bent toward the same direction to locate at the same side of the carrier plate 11, a first and a second fastening tab 13, 14 separately provided on the two opposite lateral edges of the carrier plate 11 near an end opposite to the contacts 12 and at positions offset from each other. The two contacts 12 and the first and second fastening tabs 13, 14 are oriented toward the same direction. The first and second fastening tabs 13, 14 are used to fasten and electrically connect to the core wire 21 of the cable 2. The contacts 12 are correspondingly provided on their facing sides with two concaved areas 121 for electrically connecting to the external round-shaped conductor 5.

Please refer to FIGS. 10 to 15. To assemble the terminal 1 to the cable 2, first position the core wire 21 of the cable 2 on one end of the carrier plate 11 between the first and the second fastening tab 13, 14. Then, use a tool or a fixture (not shown) to simultaneously or separately bend the first and the second fastening plate 13, 14 toward the core wire 21, so that the first and the second fastening tab 13, 14 are in direct contact with the core wire 21 to securely fasten the same to the terminal 1. With the firm fastening or pressing of the first and the second fastening tab 13, 14 against the core wire 21, the terminal 1 of the coaxial connector of the present invention is in direct contact with the core wire 21 of the cable 2. This design not only complies with the known Skin Effect to eliminate the risk of power interruption, but also ensures stable electric signal transmission without fluctuation. Moreover, since the core wire 21 of the cable 2 is in direct contact with the terminal 1 of the coaxial connector without the need of using the insulating layer 22 as a pilot, the terminal 1 can be more quickly and accurately assembled to the cable 2. Further, since the contacts 12 of the terminal 1 of the coaxial connector are correspondingly provided with concaved areas 121, a surface contact or at least a four-point contact between the connected external round-shaped conductor 5 and the contacts 12 can be achieved via the concaved areas 121. The increased contact area between the external round-shaped conductor 5 and the contacts 12 results in reduced impedance and accordingly, effectively upgraded electrical signal transmission effect.

Please refer to FIGS. 16 to 19 that illustrate the assembling of the assembled terminal 1 and cable 2 to the insulating housing 3 and the shell 4 of the coaxial connector of the present invention. As shown, the terminal 1 of the coaxial connector is received in the insulating housing 3. The insulating housing 3 includes a guiding section 31, a receiving space 32 located on one side of the insulating housing 3 for receiving the terminal 1 therein, and a pressing plate 33 outward extended from the receiving space 32 for pressing against the terminal 1. The insulating housing 3 further includes an extended portion 34 axially outward extended from an end of the guiding section 31 opposite to the pressing plate 33, a through hole 35 defined in the guiding section 31 and the extended portion 34 and communicating with the receiving space 32 for receiving the contacts 12 of the terminal 1 assembled to the insulating housing 3, and two locating blocks 36 correspondingly located at two lateral outer sides of the guiding section 31. The insulating housing 3 with the terminal 1 and the cable 2 assembled thereto is then assembled to the shell 4. The shell 4 includes a socket portion 41 for correspondingly receiving the guiding section 31 of the insulating housing 3 therein; a cover portion 42 axially outward extended from an end of the socket portion 41 for pressing against the pressing plate 33; a plurality of clamping sections 43 provided on two opposite lateral edges of the cover portion 42 for clamping onto the insulating layer 22, the braided shield 23 and the jacket 24 of the cable 2; two stoppers 44 correspondingly protruded from one side of the socket portion 41 to give the socket portion 41 a substantially U-shaped interior for receiving the guiding section 31 of the insulating housing 3 therein; two retaining sections 45 provided on the cover portion 42 for fastening to the stoppers 44; and two recesses 46 formed on an end of the socket portion 41 facing toward the cover portion 42 for separately engaging with the locating blocks 36 on the insulating housing 3.

After the terminal 1 is positioned in the receiving space 32 of the insulating housing 3, allow the contacts 12 to locate in the through hole 35. Then, directly position the guiding section 31 of the insulating housing 3 in the socket portion 41 of shell 4 with the locating blocks 36 engaging with the recesses 46. Thereafter, close the cover portion 42 of the shell 4 toward the insulating housing 3 to press against the pressing plate 33, so that the pressing plate 33 is pressed against the carrier plate 11 of the terminal 1 and the retaining sections 45 are fastened to the stoppers 44. Finally, clamp the clamping sections 43 at two lateral sides of the cover portion 42 onto the insulating layer 22, the braided shield 23 and the jacket 24 of the cable 2 to complete the coaxial connector of the present invention. With the above arrangements, the coaxial connector of the present invention has the following advantages:

(1) With the firm fastening or pressing of the first and the second fastening tab 13, 14 against the core wire 21, the terminal 1 of the coaxial connector of the present invention is directly connected to the core wire 21 of the cable 2. This design not only complies with the known Skin Effect to eliminate the risk of power interruption, but also ensures stable electrical signal transmission without fluctuation.

(2) Since the core wire 21 of the cable 2 is directly connected to the terminal 1 of the coaxial connector without the need of using the insulating layer 22 as a pilot, the terminal 1 can be more quickly and accurately assembled to the cable 2.

(3) Since the contacts 12 of the terminal 1 of the coaxial connector are correspondingly provided with concaved areas 121, a surface contact or at least a four-point contact between the connected external round-shaped conductor 5 and contacts 12 can be achieved via the concaved areas 121. And, the increased contact area between the external round-shaped conductor 5 and the contacts 12 results in reduced impedance and accordingly, effectively upgraded electrical signal transmission effect.

(4) The contacts 12 as well as the first and second fastening tabs 13, 14 on the terminal 1 are oriented toward the same direction to eliminate the problem of increased assembly height and to facilitate easy component arrangement in miniature component design.

(5) The socket portion 41 of the shell 4 has a substantially U-shaped interior, which allows direct and easy placing and locating of the guiding section 31 of the insulating housing 3 in the socket portion 41 without the need of using additional tools.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A coaxial connector for electrically connecting a cable having a core wire to an external round-shaped conductor, comprising:

a terminal including a carrier plate; two contacts correspondingly provided on two opposite lateral edges of the carrier plate and bent toward the same direction to locate at the same side of the carrier plate; and a first and a second fastening tab separately provided on the two opposite lateral edges of the carrier plate near an end of the carrier plate opposite to the contacts and located at positions offset from each other; wherein the two contacts and the first and second fastening tabs are oriented toward the same direction; the first and second fastening tabs are used to directly fasten and electrically connect to the core wire of the cable; and the contacts are correspondingly provided on their facing sides with two concaved areas for electrically connecting to the external round-shaped conductor;

an insulating housing including a guiding section; a receiving space located on one side of the insulating housing for receiving the terminal therein; and a pressing plate outward extended from the receiving space for pressing against the terminal; and a shell including a socket portion for correspondingly receiving the guiding section of the insulating housing therein; a cover portion axially outward extended from an end of the socket portion for pressing against the pressing plate; nd a plurality of clamping sections provided on two opposite lateral edges of the cover portion for clamping onto the cable.

2. The coaxial connector as claimed in claim 1, wherein the shell further includes two stoppers correspondingly protruded from the socket portion to give the socket portion a substantially U-shaped interior for receiving the guiding section of the insulating housing therein, and two retaining sections provided on the cover portion for fastening to the two stoppers.

3. The coaxial connector as claimed in claim 1, wherein the insulating housing further includes an extended portion axially outward extended from an end of the guiding section opposite to the pressing plate, and a through hole defined in the guiding section and the extended portion and communicating with the receiving space for receiving the contacts of the terminal therein.

4. The coaxial connector as claimed in claim 1, wherein the insulating housing further includes two locating blocks correspondingly located at two lateral outer sides of the guiding section, and the shell further includes two recesses formed on an end of the socket portion facing toward the cover portion for separately engaging with the locating blocks on the insulating housing.

* * * * *